US011170649B2

(12) United States Patent
Ganesan et al.

(10) Patent No.: US 11,170,649 B2
(45) Date of Patent: Nov. 9, 2021

(54) INTEGRATED COLLISION AVOIDANCE AND ROAD SAFETY MANAGEMENT SYSTEM

(71) Applicant: International Business Machines Corporation, Armonk, NY (US)

(72) Inventors: Ambhighainath Ganesan, White Plains, NY (US); Sherif A. Goma, Hawthorne, NY (US); Chelsea Grindle, White Plains, NY (US); Dakota Fried, New York, NY (US); Kevin Chang, New York, NY (US); Raphael Ezry, New York, NY (US)

(73) Assignee: International Business Machines Corporation, Armonk, NY (US)

( * ) Notice: Subject to any disclaimer, the term of this patent is extended or adjusted under 35 U.S.C. 154(b) by 65 days.

(21) Appl. No.: 16/801,844

(22) Filed: Feb. 26, 2020

(65) Prior Publication Data

US 2021/0264790 A1 Aug. 26, 2021

(51) Int. Cl.
*G08G 1/16* (2006.01)
*G08G 1/01* (2006.01)

(52) U.S. Cl.
CPC ..... *G08G 1/166* (2013.01); *G08G 1/0129* (2013.01); *G08G 1/164* (2013.01)

(58) Field of Classification Search
CPC ..... G08G 1/166; G08G 1/0129; G08G 1/164
See application file for complete search history.

(56) References Cited

U.S. PATENT DOCUMENTS

| | | | | |
|---|---|---|---|---|
| 6,662,141 | B2 | 12/2003 | Kaub | |
| 6,903,677 | B2 | 6/2005 | Takashima et al. | |
| 9,242,654 | B2 * | 1/2016 | Do | B60W 40/09 |
| 9,718,468 | B2 * | 8/2017 | Barfield, Jr. | G08G 1/096775 |
| 2009/0040054 | A1 | 2/2009 | Wang et al. | |
| 2014/0279707 | A1 * | 9/2014 | Joshua | G06Q 30/0283 705/400 |
| 2015/0375756 | A1 * | 12/2015 | Do | B60W 30/0956 701/1 |
| 2017/0101093 | A1 * | 4/2017 | Barfield, Jr. | G08G 1/096775 |

FOREIGN PATENT DOCUMENTS

| | | | |
|---|---|---|---|
| CN | 102231231 | A | 11/2011 |
| IN | 201641025927 | A | 3/2018 |
| JP | 6045846 | B2 | 12/2016 |

* cited by examiner

*Primary Examiner* — Sisay Yacob
(74) *Attorney, Agent, or Firm* — Haley J. McClory

(57) ABSTRACT

A collision avoidance and road safety system is applied to a road network comprised of a plurality of road segments for a location to produce real time or dynamic forecasting of collision risk and root causes of the potential collision.

20 Claims, 8 Drawing Sheets

INTEGRATED COLLISION AVOIDANCE AND ROAD SAFETY MANAGEMENT SYSTEM

BACKGROUND

The present invention relates to road safety management systems, and more specifically to integrated collision avoidance for a road safety management system.

Current road safety management systems are specifically concerned with predicting collisions based only for a specific driver at specific intersections or only at the moment just prior to collision. The causes of collisions is often not known or determined and can vary between drivers.

SUMMARY

According to one embodiment of the present invention, a method of determining a collision risk forecast and root cause of the collision risk for road segments of a road network is disclosed. The method comprising the steps of: a computer receiving data representative of real time conditions, real time social events, and historic conditions associated with road segments from a plurality of devices; the computer determining a probability of collision risk for each road segment including the root cause; and the computer sending a notification to at least some of the plurality of devices regarding the collision risk and root causes of collision for at least one road segment. The step of the computer determining a probability of collision risk for each road segment including the root cause comprising the steps of the computer: determining all road segments of the road network from the data representative of real time conditions and social events; applying data representative of historical conditions to each road segment to down sample data to account for imbalances and determine a number of collisions in each road segment; determining major factors of relevance for causing collisions for each road segment from data received representative of real time conditions, real time social events and historic conditions; applying models to the major factors of relevance to determine conditional probabilities and dependencies causing collisions in each road segment; spatially smoothing the conditional probability of each road segment to determine a collision risk index with continuous metrics to create a spatial low pass filter; applying the spatial low pass filter to each road segment to remove discontinuities; and simulating continuous probability to determine a road network risk estimation with a collision risk forecast and root cause of the collision risk for each road segment.

According to another embodiment of the present invention, a computer program product for determining a collision risk forecast and root cause of a collision risk for road segments of a road network using a decision making engine is disclosed. The decision making engine having a computer comprising at least one processor, one or more memories, one or more computer readable storage media, the computer program product comprising a computer readable storage medium having program instructions embodied therewith. The program instructions executable by the computer to perform a method comprising: receiving, by the computer, data representative of real time conditions, real time social events, and historic conditions associated with each road segment from a plurality of devices; determining, by the computer, a probability of collision risk for each road segment including the root cause; and sending, by the computer, a notification to at least some of the plurality of devices regarding the collision risk and root causes of collision for at least one road segment. The program instructions of determining, by the computer, a probability of collision risk for each road segment including the root cause comprising the program instructions of: identifying all road segments of the road network from the data representative of real time conditions and social events; applying data representative of historical conditions to each road segment to down sample data to account for imbalances and determine a number of collisions in each road segment; determining major factors of relevance for causing collisions in each road segment from data received representative of real time conditions, real time social events and historic conditions; applying models to the major factors of relevance to determine conditional probabilities and dependencies causing collisions in each road segment; spatially smoothing the conditional probability of each road segment to determine a collision risk index with continuous metrics to create a spatial low pass filter; applying the spatial low pass filter to each road segment to remove discontinuities; and simulating continuous probability to determine a road network risk estimation with a collision risk forecast and root cause of the collision risk for each road segment.

According to another embodiment of the present invention, computer system for determining a collision risk forecast and root cause of a collision risk for road segments of a road network comprising a decision making engine and a plurality of devices is disclosed. The decision making engine comprising at least one processor, one or more memories, one or more computer readable storage media having program instructions executable by the computer to perform the program instructions. The program instructions comprising: receiving, by the computer, data representative of real time conditions, real time social events, and historic conditions associated with each road segment from a plurality of devices; determining, by the computer, a probability of collision risk for each road segment including the root cause; and sending, by the computer, a notification to at least some of the plurality of devices regarding the collision risk and root causes of collision for at least one road segment. The program instructions of determining, by the computer, a probability of collision risk for each road segment including the root cause comprising the program instructions of: identifying all road segments of the road network from the data representative of real time conditions and social events; applying data representative of historical conditions to each road segment to down sample data to account for imbalances and determine a number of collisions in each road segment; determining major factors of relevance for causing collisions in each road segment from data received representative of real time conditions, real time social events and historic conditions; applying models to the major factors of relevance to determine conditional probabilities and dependencies causing collisions in each road segment; spatially smoothing the conditional probability of each road segment to determine a collision risk index with continuous metrics to create a spatial low pass filter; applying the spatial low pass filter to each road segment to remove discontinuities; and simulating continuous probability to determine a road network risk estimation with a collision risk forecast and root cause of the collision risk for each road segment.

DETAILED DESCRIPTION

In an embodiment of the present invention, a collision avoidance and road safety system is applied to a road network comprised of a plurality of road segments for a location. The road safety system includes a plurality of devices providing continuous real time data to a decision making engine. The decision making engine additionally receives historical data of traffic flow and incident data. Each road segment can be defined or set by mile markers, street names, route designations or other factors or boundaries. Each segment is a small enough subsection over which the variation in probabilities, which will be calculated, is minimal. These segments are in both 'x' and 'y' dimensions of the road—i.e. length and width of the road. Mile markers or even smaller divisions would be on the 'x' or length dimension. Each lane could serve as the elemental division on the 'y' or width dimension.

The system determines a collision risk forecast and root causes of accidents, collisions or other incidents for at least one, but preferably a plurality of road segments of the road network. In one embodiment, the collision risk forecast and root causes of accidents, collisions, or other incidents are determined for each road segment of the road network. For any collision forecast with a probability above a threshold, a notification is sent to one or more of the devices in which data was received regarding the road segment, traffic signals or lights in a specific road segment, devices associated with law enforcement, devices associated with emergency services, or other entities that can contribute to the management of the road segment. Other entities can include, but is not limited to public works department, traffic officials, vehicles, emergency vehicles, and pedestrians.

The decision making engine can understand root causes of historical collisions while predicting risk through the use of historical modeling to elucidate major factors and infer relationships between factors to forecast collision risk for each road segment. Real time or dynamic risk forecasting is created through incorporation of real time non-vehicular Internet of Things (IoT) sensor data such as traffic cameras, security camera feeds and traffic lights. The decision making engine additionally integrates individual driver behavior as well as environmental factors in estimating collision risk and applies spatial smoothing filters to remove discontinuities in the estimated collision risk.

Figure 1:
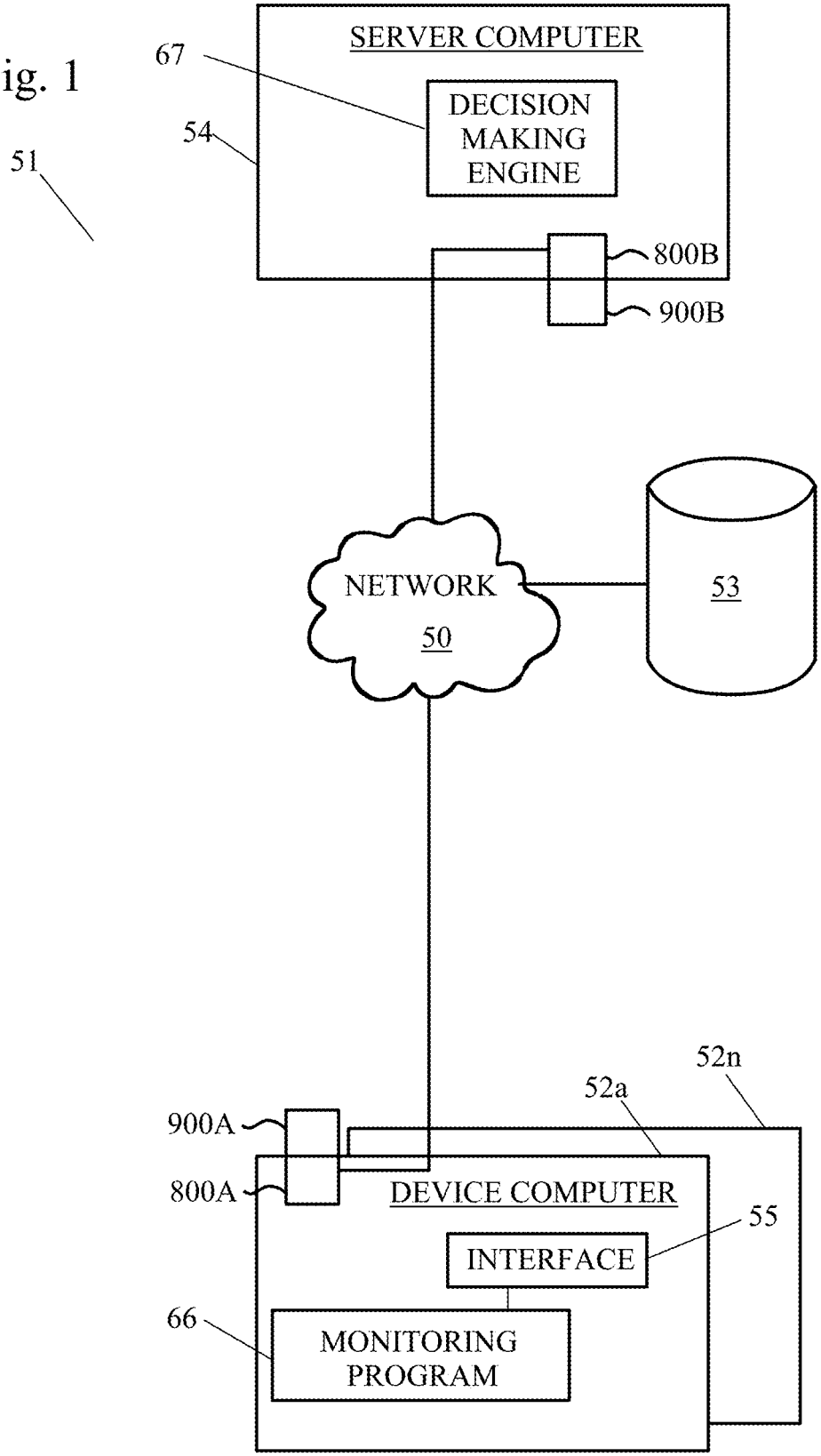
FIG. 1 depicts an exemplary diagram of a possible data processing environment in which illustrative embodiments may be implemented.

FIG. 1 is an exemplary diagram of a possible data processing environment provided in which illustrative embodiments may be implemented. It should be appreciated that FIG. 1 is only exemplary and is not intended to assert or imply any limitation with regard to the environments in which different embodiments may be implemented. Many modifications to the depicted environments may be made.

Referring to FIG. 1, network data processing system 51 is a network of computers in which illustrative embodiments may be implemented. Network data processing system 51 contains network 50, which is the medium used to provide communication links between various devices and computers connected together within network data processing system 51. Network 50 may include connections, such as wire, wireless communication links, or fiber optic cables. The network processing system 51 can be implemented in the collision avoidance and road safety architecture system shown in FIG. 3.

In the depicted example, a plurality of device computers 52*a*-52*n*, a repository 53, and a server computer 54 connect to network 50. In other exemplary embodiments, network data processing system 51 may include additional client or device computers, storage devices or repositories, server computers, and other devices not shown.

The device computers 52*a*-52*n* may contain an interface 55, which may accept commands and data entry from a user. The commands may be regarding parameters to be monitored and/or notification parameters regarding notifications to receive. The interface can be, for example, a command line interface, a graphical user interface (GUI), a natural user interface (NUI) or a touch user interface (TUI). The device computers 52*a*-52*n* preferably includes a monitoring program 66. The monitoring program 66 can execute continuous or discontinuous monitoring, send data associated with monitoring or a parameter and receive notifications regarding events, or a probability of events, that would occur on a specific road segment(s). While not shown, it may be desirable to have the monitoring program 66 be present on the server computer 54. The device computer 52*a*-52*n* includes a set of internal components 800*a* and a set of external components 900*a*, further illustrated in FIG. 2. The device computer 52*a*-52*n* can include, but is not limited to Internet of Things (Iot) devices, such as video cameras, traffic cameras, road sensors, and vehicle sensors.

Figure 2:
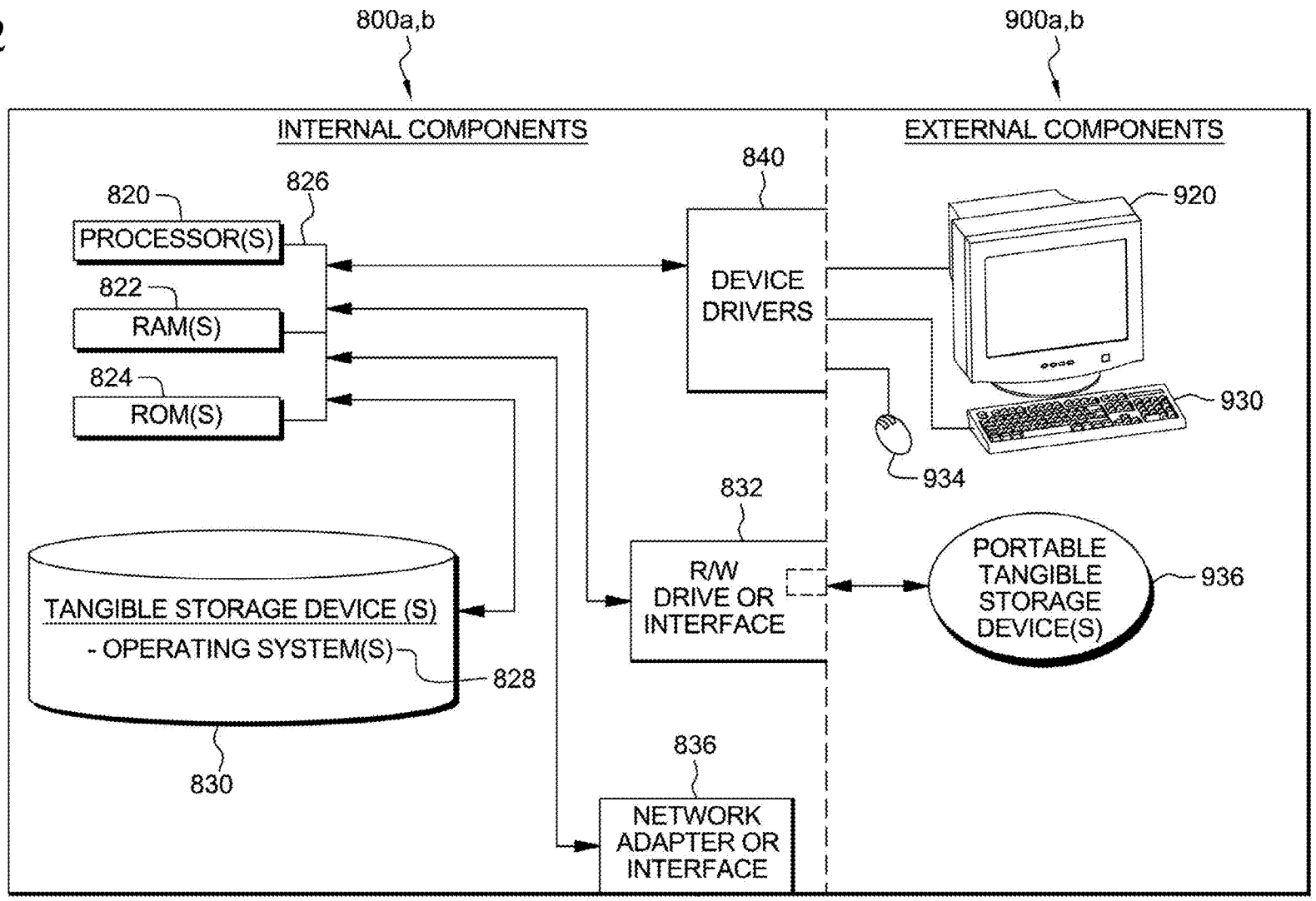
FIG. 2 illustrates internal and external components of a client computer and a server computer in which illustrative embodiments may be implemented.

Server computer 54 includes a set of internal components 800*b* and a set of external components 900*b* illustrated in FIG. 2. In the depicted example, server computer 54 provides information, such as boot files, operating system images, and applications to the device computer 52. The server computer 54 can receive information from the device computers 52*a*-52*n* as well as other sources. The information can include, but is not limited to real time traffic flow data, real time incident data, telematics and other IoT data, real time weather data, real time events, and social feeds. Server computer 54 can compute the information locally or extract the information from other computers or repositories 53 on network 50. For example, server computer 54 can extract historic traffic data and historic incident data from repository 53. Additionally, instead of receiving real time weather data, real time events and social feeds, the server computer 53 can extract this data from a third party source. The server computer 54 contains a decision making engine program 67. The decisions making engine program 67 can determine a collision risk forecast and root causes of incidents for specific road segments of a road network and transmit the forecast as well as the root causes to an appreciate device computer.

Program code and programs such as monitoring program 66 and decision making engine program 67 may be stored on at least one of one or more computer-readable tangible storage devices 830 shown in FIG. 2, on at least one of one or more portable computer-readable tangible storage devices 936 as shown in FIG. 2, or in repository 53 connected to network 50, or may be downloaded to device computers 52*a*-52*n*, or server computer 54, for use. For example, program code and programs such as monitoring program 66 and decision making engine program 67 may be stored on at least one of one or more storage devices 830 on server computer 54 and downloaded to device computer 52*a*-52*n* over network 50 for use. Alternatively, server computer 54 can be a web server, and the program code, and programs such as monitoring program 66 may be stored on at least one of the one or more storage devices 830 on server computer 54 and accessed by device computer 52*a*-52*n*. In other exemplary embodiments, the program code, and programs such as monitoring program 66 may be stored on at least one of one or more computer-readable storage devices 830 on device computer 52*a*-52*n* or distributed between two or more servers.

In the depicted example, network data processing system 51 is the Internet with network 50 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, governmental, educational and other computer systems that route data and messages. Network data processing system 51 also may be implemented as a number of different types of networks, such as, for example, an intranet, local area network (LAN), or a wide area network (WAN). FIG. 1 is intended as an example, and not as an architectural limitation, for the different illustrative embodiments.

FIG. 2 illustrates internal and external components of device computers 52*a*-52*n* and server computer 54 in which illustrative embodiments may be implemented. In FIG. 2, device computers 52*a*-52*n* and a server computer 54 include a least some of the components of respective sets of internal components 800*a*, 800*b* and external components 900*a*, 900*b*. Each of the sets of internal components 800*a*, 800*b* includes one or more processors 820, one or more computer-readable RAMs 822 and one or more computer-readable ROMs 824 on one or more buses 826, and one or more operating systems 828 and one or more computer-readable tangible storage devices 830. The one or more operating systems 828, monitoring program 66, and decision making engine program 67 are stored on one or more of the computer-readable tangible storage devices 830 for execution by one or more of the processors 820 via one or more of the RAMs 822 (which typically include cache memory). In the embodiment illustrated in FIG. 2, each of the computer-readable tangible storage devices 830 is a magnetic disk storage device of an internal hard drive. Alternatively, each of the computer-readable tangible storage devices 830 is a semiconductor storage device such as ROM 824, Erasable Programmable Read-Only Memory (EPROM), flash memory or any other computer-readable tangible storage device that can store a computer program and digital information.

Each set of internal components 800*a*, 800*b* also includes a R/W drive or interface 832 to read from and write to one or more portable computer-readable tangible storage devices 936 such as a CD-ROM, DVD, memory stick, magnetic tape, magnetic disk, optical disk or semiconductor storage device. Monitoring program 66 and/or decision making engine program 67 can be stored on one or more of the portable computer-readable tangible storage devices 936, read via R/W drive or interface 832 and loaded into hard drive 830.

Each set of internal components 800*a*, 800*b* also includes a network adapter or interface 836 such as a TCP/IP adapter card. Monitoring program 66 and decision making program engine 67 can be downloaded to the device computer 52*a*-52*n* and server computer 54, respectively, from an external computer via a network (for example, the Internet, a local area network or other, wide area network) and network adapter or interface 836. From the network adapter or interface 836, monitoring program 66 and decision making engine program 67 are loaded into hard drive 830. Monitoring program 66 and decision making engine program 67 can be downloaded to the server computer 54 from an external computer via a network (for example, the Internet, a local area network or other, wide area network) and network adapter or interface 836. From the network adapter or interface 836, monitoring program 66 and decision making engine program 67 are loaded into hard drive 830. The network may comprise copper wires, optical fibers, wireless transmission, routers, firewalls, switches, gateway computers and/or edge servers.

Each of the sets of external components 900*a*, 900*b* includes a computer display monitor 920, a keyboard 930, and a computer mouse 934. Each of the sets of internal components 800*a*, 800*b* also includes device drivers 840 to interface to computer display monitor 920, keyboard 930 and computer mouse 934. The device drivers 840, R/W drive or interface 832 and network adapter or interface 836 comprise hardware and software (stored in tangible storage device 830 and/or ROM 824).

Monitoring program 66 and decision making engine program 67 can be written in various programming languages including low-level, high-level, object-oriented or non object-oriented languages. Alternatively, the functions of monitoring program 66 and decision making engine program 67 can be implemented in whole, or in part, by computer circuits and other hardware (not shown).

Figure 3:
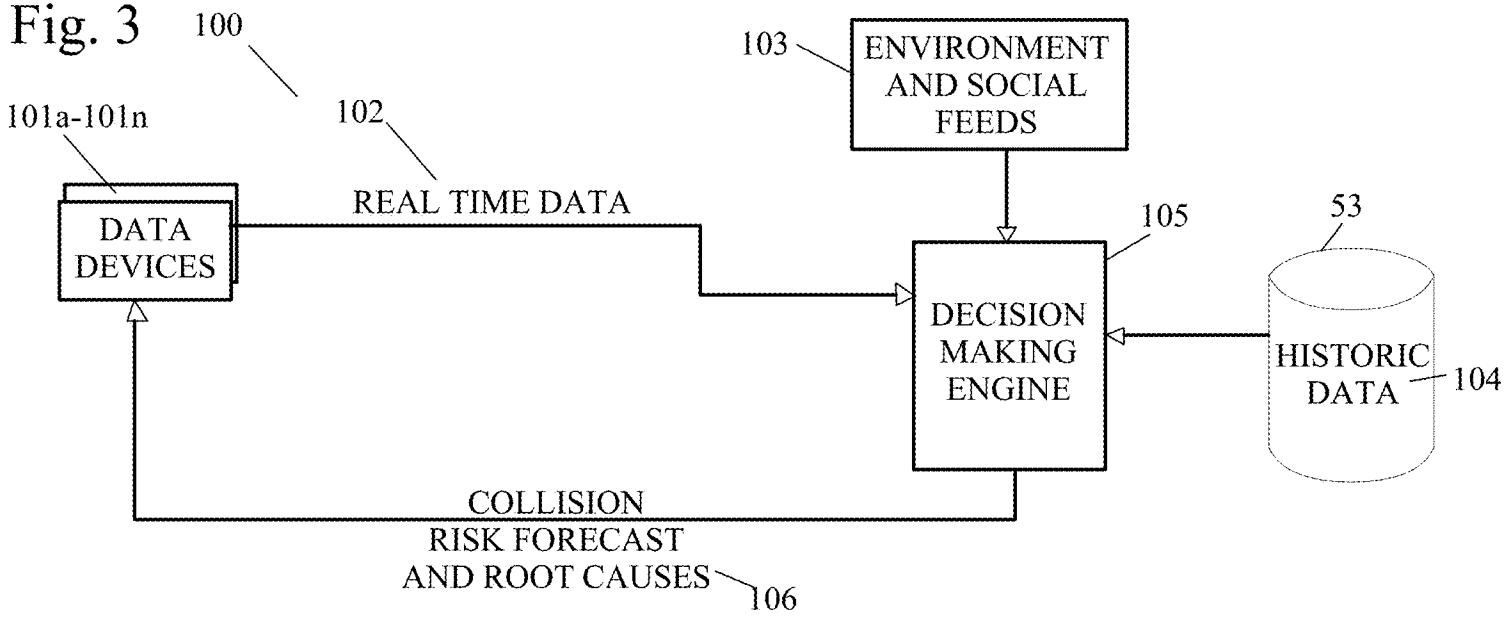
FIG. 3 shows a schematic of a collision avoidance and road safety architecture system.

FIG. 3 is a schematic of a collision avoidance and road safety architecture system.

Data devices 101*a*-101*n* monitor and send real time data 102 to the decision making engine 105 via the monitoring program 66. The data devices 101*a*-101*n* monitor various variables associated with a road segment. The data devices 101*a*-101*n* preferably include device computers 52*a*-52*n* and the data devices can be, but are not limited to, IoT devices, personal devices of drivers or pedestrians, alert systems for law enforcement or emergency services, vehicle sensors, systems associated with public works or traffic controllers. The real time data 102 can include, but is not limited to road segment data such as road surface, road length, angle or ascent, real time traffic flow data, real time incident data, telematics and other IoT data associated with driver behavior such as current speed, location, probable drive time or location; and real time weather data.

The decision making engine 105 via the decision making engine program 67 also receives environmental and social feeds data 103 from external sources relative to the data devices 101*a*-101*n*. This data may be received from a third party and may be mined from the Internet. The data can include, but is not limited to weather data including wind speed, precipitation, and temperature; event data; and social feeds geographically located on or associated with a specific road segment. The event data is preferably regarding incidents associated with one or more road segments, such as accidents, traffic, road closures, construction and any impact that may affect the road segment. For example, using the data from the social feed, it may be determined that on a specific road segment parking is being setup for a music concert which is planning on drawing thousands of people.

Lastly, the decision making engine 105, via the decision making engine program 67, receives historic traffic flow data and historic incident data, as well as other historically relevant data to the road segments from a repository, such as repository 53.

The decision making engine 105, via the decision making engine program 67, determines a collision risk forecast and root cause of the collision risk 106 for at least one road segment of a road network. The collision risk forecast and root cause of the collision risk 106 is then sent to data devices 101*a*-101*n*.

In one embodiment, the collision risk forecast and root causes 106 can be sent only back to the devices which monitored the real time data associated with the road segment. In another embodiment, the collision risk forecast and root causes 106 are sent to specific entities to aid reducing or alleviating the collision risk such as law enforcement, traffic controllers, traffic devices, such as traffic lights, emergency services, and public works department. The collision risk forecast and root causes 106 can also be sent to specific devices, such as smartphones of users located on specific road segments or traveling along or to road segments. The collision risk forecast is for a time period in the future at preferred time intervals, such as daily and weekly. The collision risk forecast can be specific to a type of driver behavior, a road type and/or a specific vehicle type.

Figure 4:
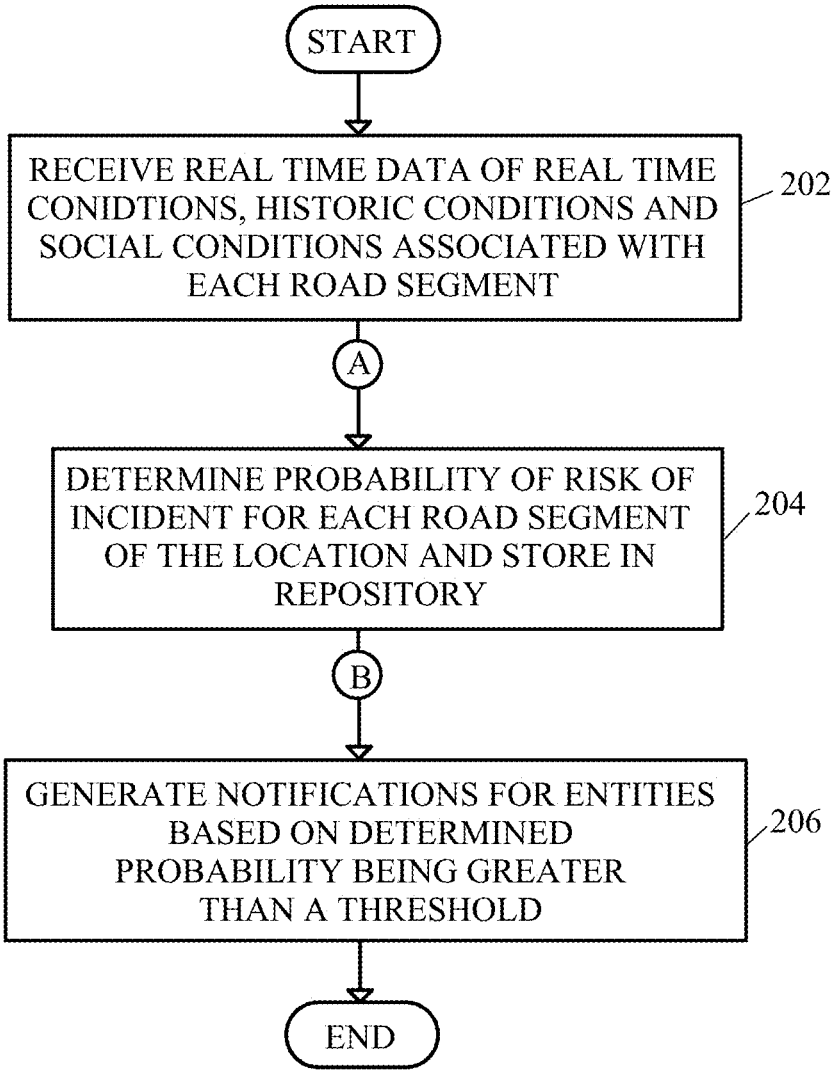
FIG. 4 shows a flowchart of a method of determining a collision risk forecast and root cause of the collision risk for at least one road segment of a road network.

FIG. 4 shows a flow diagram of a method of determining a collision risk forecast and root cause of the collision risk for each road segment of a road network.

In a first step, the decision making engine 105, for example via the decision making engine program 67, receives real data representative of real time conditions, historic conditions and social conditions associated for every road segment (step 202). As discussed above, the data is received from data devices 101*a*-101*n* via the monitoring program 66. The data can include, but is not limited to: road segment data such as road surface, road length, angle or ascent, real time traffic flow data, real time incident data, telematics and other IoT data associated with driver behavior such as current speed, location, probable drive time or location; real time weather data including wind speed, precipitation, and temperature; event data; social feeds geographically located on or associated with a specific road segment; historic traffic flow data; and historic incident data.

Next, the decision making engine 105, for example via the decision making engine program 67, determines a probability of the risk of a collision or incident for each road segment including the root cause and stores the probability and associated root causes in a repository (step 204), for example repository 53.

The decision making engine 105, for example via the decision making engine program 67, for each probability of a risk that exceeds a predetermined threshold, sends a notification to data devices regarding the risk and the root causes of the road segment (step 206) and the method ends.

Figure 5:
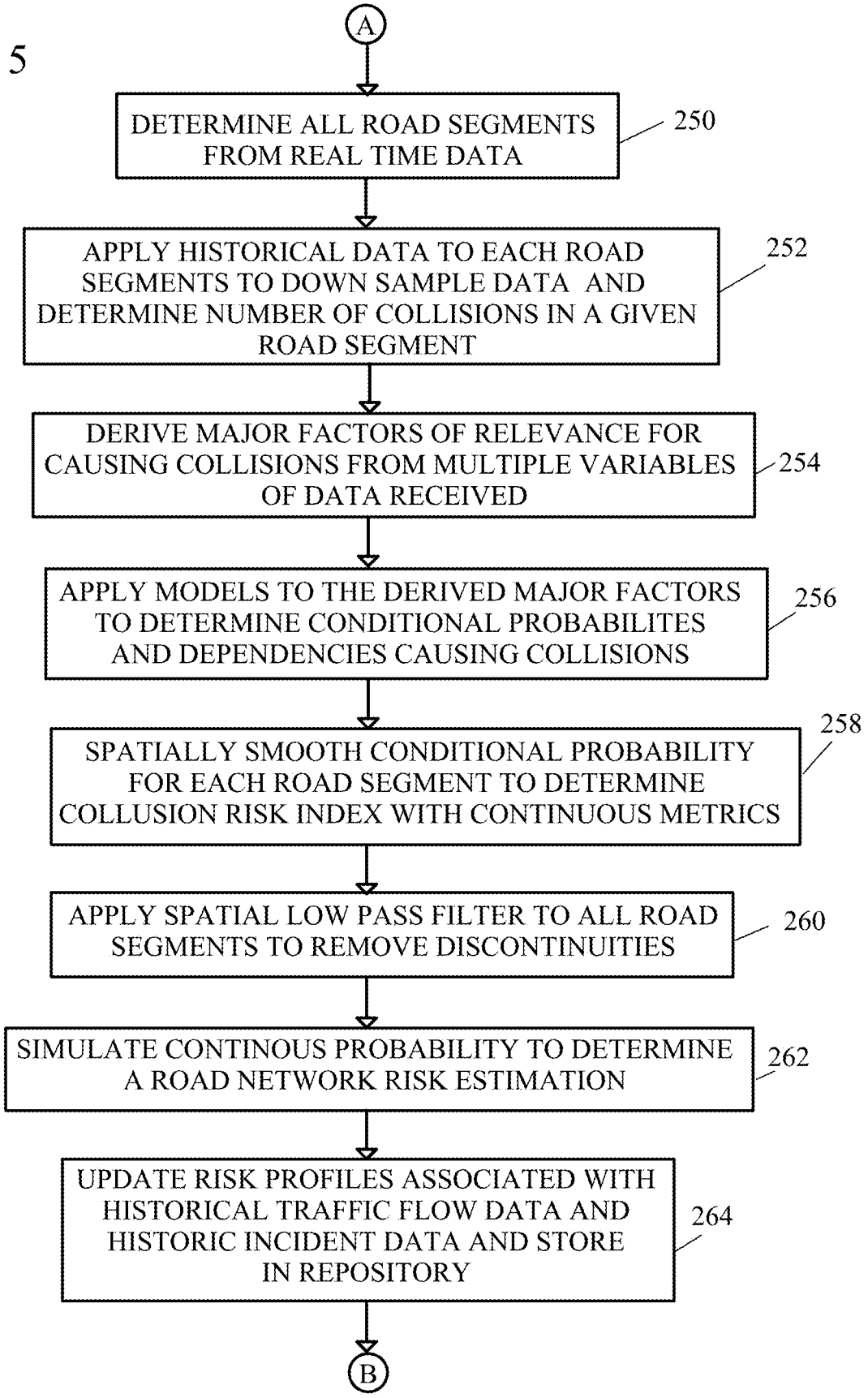
FIG. 5 shows a flowchart of a method of determining the probability of a risk of an incident for each road segment of a road network.

FIG. 5 shows a flow diagram of the sub-steps of step 204 of determining a probability of the risk of a collision or incident for each road segment including the root cause and storing the probability and associated root causes in a repository by the decision making engine program 67.

In a first sub-step, the decision making engine program 67 determines all road segments of the road network from the real time data (step 250).

Next, the decision making engine program 67 applies historical data to each road segment to down sample data to account for an imbalance in classes present in the real time data and determines the number of collisions in each given road segment (step 252). The classes are representative of types of collisions that occurred for each road segment. For example, classes may be assigned to each type collision, such as, but not limited to fender bender, pile up, scratches, etc. Imbalances can occur due to a frequency of collisions that occur and therefore the data available for each class is different. For example, in a given day, there may be twenty instances of a fender bender and one instance of a pile up. The imbalance may be accounted for using down sampling of data.

The decision making engine program 67 derives major factors of relevance for the cause of collisions from the data received for each road segment (step 254). The factors which are determined for the collisions are intrinsic combinations of causes that can aid in explaining a collision. For example, probability of rain, probability of wind speed being more than 30 mph, etc. can be mathematically combined into a "weather" factor.

Figure 6:
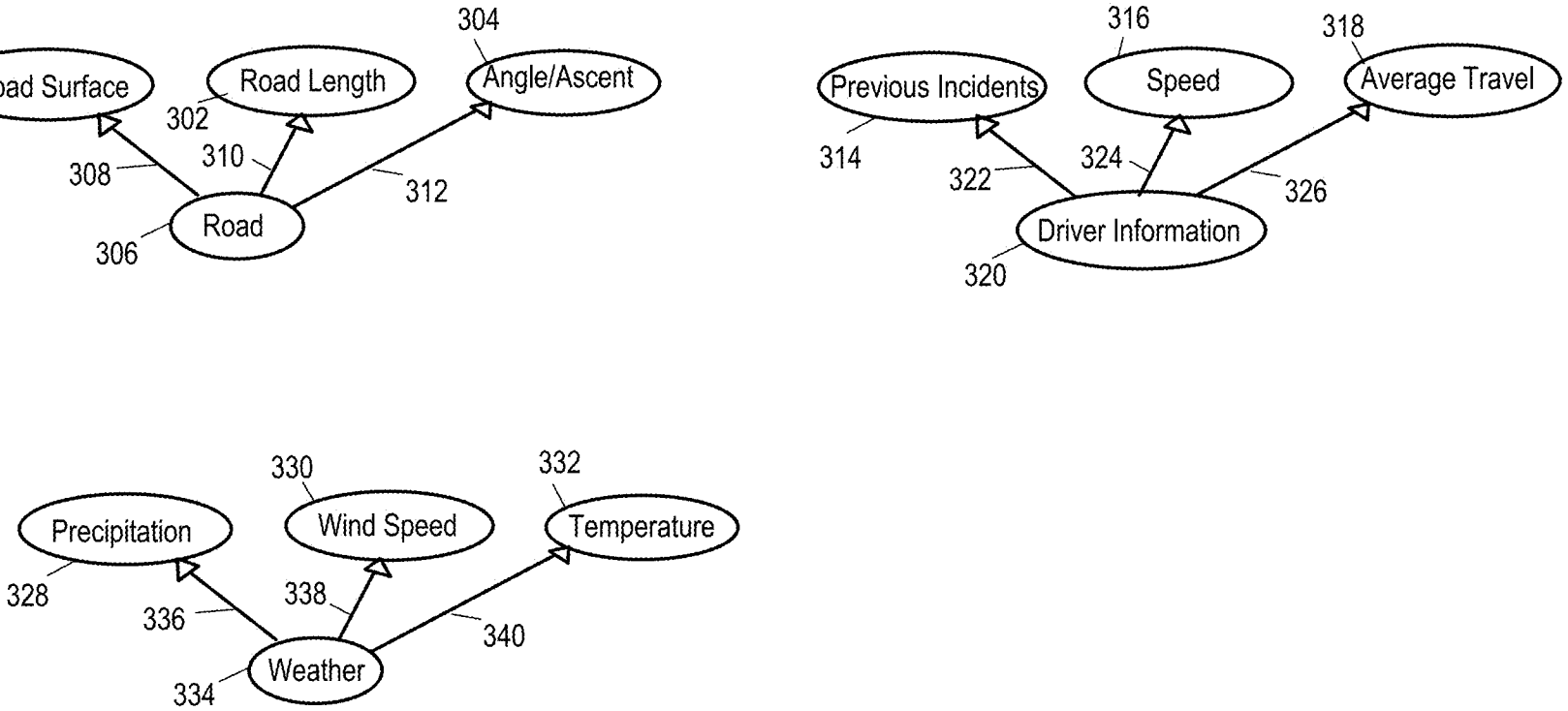
FIG. 6 shows an example of factors associated with a road segment for exploratory factor analysis.

Referring to FIG. 6, the data received is parsed into observed variables and an associated factor for each road segment. Factor loading is present between the factors and the observed variables.

The factors detailed below and in the figure are only examples and not meant to be exhaustive. Factors would be derived based on all available variables. The number of factors and identity of factors can vary based on all the variables available. For example, data regarding observable variables associated data road conditions could be combined into a road factor. Observable variables associated with vehicles of vehicle speed, vehicle maintenance data, etc. could be combined into a vehicle factor.

As an example, a major factors (F) of a road 306 can have observed variable (z) of road surface 300, road length 302 and angle/ascent 304 with factor loading 308, 310, 312 present between the major factors (F) of the road 306 and the observed variables (z) of road surface 300, road length 302 and angle/ascent 304. The observed variable (z) for major factors (F) of driver information 320 can be previous incidents 314, speed 316, average travel amount 318 with factor loading 322, 324, 326 present between the driver information 320 and previous incidents 314, speed 316 and average travel amount 318. The observed variable (z) for major factors (F) of weather 334 can be precipitation 328, wind speed 330 and temperature 332 with factor loading 336, 338, 340 present between the weather 334 and precipitation 328, wind speed 330 and temperature 332. The observed variable (z) are preferably determined using exploratory factor analysis using equation 1.1.

$$z_{i,j}=l_{1,1}F_{1,i}+l_{1,2}F_{2,i}+\epsilon_{1,j}$$

$$\vdots\ \vdots\ \vdots\ \vdots$$

$$z_{10,i}=l_{10,1}F_{1,j}+l_{10,2}F_{2,j}\epsilon_{10,j} \tag{1.1}$$

With:

Z=observed variable l=factor loading

F=factor

ε=error variance

Models are then applied to the derived major factors to determine conditional probabilities and dependencies causing collisions for each road segment (Step 256).

Figure 7:
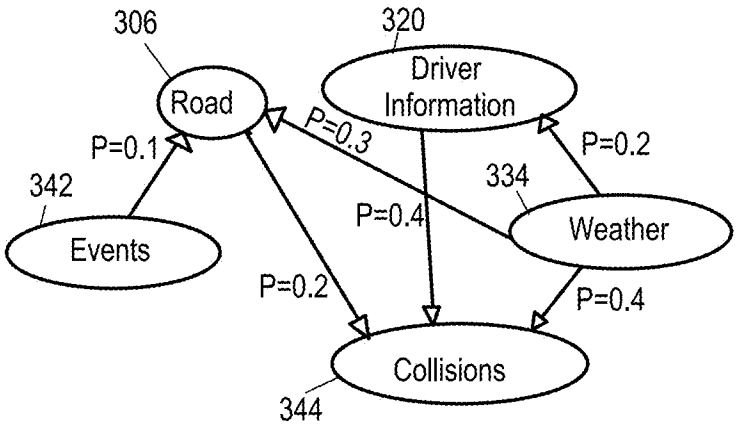
FIG. 7 shows an example of a Bayesian Network Inference or confirmatory factor analysis.

Referring to FIG. 7, major factors (F) of: road 306, driver information including driver behavior 320 and weather 334 each have a conditional probability P relative to collision 344. Other events 342 can also be factored in relative to the road 306, for example social events or construction. A conditional probability P is also determined for events 342 causing changes to, or impacting, the road 306 and weather 334 causing changes on, or impacting, driving behavior/information 320. The conditional probability P is preferably calculated for each road segment using a Bayesian Network Inference or confirmatory factor analysis for each factor using equation 1.2.

$$P(\text{Collision}=1)=P(\text{Collision}|\text{Condn}_i)*P(\text{Condn}_i)+P(\text{Collision}|\text{Cond}_i \,\&\, \text{Condn}_j)*P(\text{Condn}_i)*P(\text{Cond}_j)+\ldots \quad (1.2)$$

With
i=major factor i
j=major factor j

The conditional probability for each road segment is spatially smoothed through a spatial low pass filter to determine a collision risk index with continuous metrics (step 258). After calculating the probability for each road segment, mathematical discontinuities in the probability function may be present and need to be accounted for.

Having calculated the probability for each segment or element of the road, mathematical discontinuities in the probability function can occur.

It should be noted that the number of divisions or road segments is not fixed and can vary by the road and analysis requirements. The following calculations are therefore examples only and not to be interpreted that each road segment is analyzed with 0<x<0.1 etc.

Figure 8:
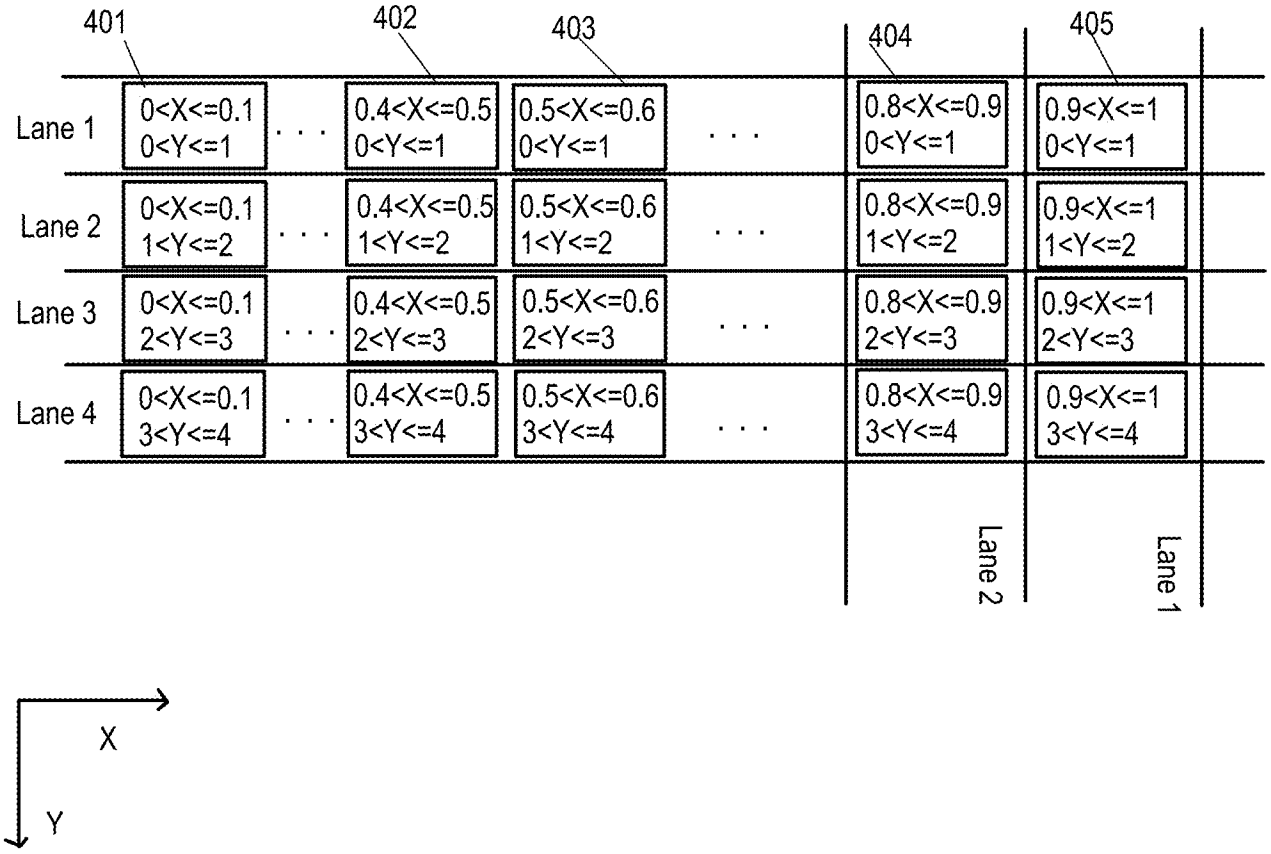
FIG. 8 shows an example of road segments and conditional probabilities for each road segment.

Referring to FIG. 8, for example, for a road length of 1 mile, the road length is separated into ten road segments on the 'x' or length dimension and in the 1st lane. For brevity, only five road segments per lane are shown. Similar elements are present in the second lane.

Table 1 below shows raw probabilities calculated for each road segment at any given time point 't'.

TABLE 1

| | 0 < x ≤ 0.1 | . . . | 0.4 < x ≤ 0.5 | 0.5 < x ≤ 0.6 | . . . | 0.8 < x ≤ 0.9 | 0.9 < x ≤1 |
|---|---|---|---|---|---|---|---|
| 0 < y ≤ 1 | 0.2 | . . . | 0.4 | 0.5 | . . . | 0.2 | 0.3 |
| 1 < y ≤ 2 | 0.3 | . . . | 0.3 | 0.2 | . . . | 0.6 | 0.5 |
| 2 < y ≤ 3 | 0.25 | . . . | 0.33 | 0.4 | . . . | 0.6 | 0.4 |
| 3 < y ≤ 4 | 0.4 | . . . | 0.35 | 0.4 | . . . | 0.5 | 0.3 |

The probability or collision in each of the ten road segments in Lane 1 is P(Collision=1), where for the first road segment 401 the probability of collision is P(Collision=1 for 0<x≤0.1, 0<y≤1)=0.2, the probability of collision for another road segment 402 is P(Collision=1 for 0.4<x≤0.5, 0<y≤1)=0.4, the probability of collision for an adjacent road segment 403 is P(Collision=1 for 0.5<x≤0.6, 0<y≤1)=0.5, the probability of collision of the another road segment 404 is P(Collision=1 for 0.8<x≤0.9, 0<y≤1) is 0.2 and the probability of collision of road segment 405 is P(Collision=1 for 0.9<x≤1, 0<y≤1) is 0.3. Examples of road segments are shown in the other lanes but are not discussed for brevity.

A spatial low pass filter is applied to the probabilities of each road segment to smooth the probability curve as a function of x, y. As a result, for lane 1, the probability is P(Collision=1 for any x and y) as a continuous function.

Smoothing the probabilities and applying the low pass filter to probabilities of each road segment is applied through equation 1.3 shown below.

$$P(x, y, t) = \sum_{k=x-dx}^{x+dx} \sum_{l=y-dy}^{y+dy} w(k, l) * P(k, l, t) \quad (1.3)$$

With:
x=length dimension of the road
y=width dimension of the road
t=time
w=weight
k=road segment on dimension
l=road segment on 'y' dimension Then a continuous probability is simulated to determine a road network risk estimation with a collision risk forecast and root cause of the collision risk for each road segment (step 262). The root cause(s) of the collision risk for each road segment is determined by factor analysis. The collision risk forecast is for a time period in the future at preferred time intervals, such as daily and weekly. The collision risk forecast can be specific to a type of driver behavior, a road type and/or a specific vehicle type and may be generated by forecasting models. The forecasting models are based on the determined probability of each road segment based length dimensions, width dimensions and time. An example of a forecasting model used is a time series model to generate a collision risk forecast for determined future time periods.

For example, based on the road segments shown in FIG. 8, the collision risk forecast for road segment 403 in lane 1 may be high for a fender bender in the rain due to slipper road conditions at night and such conditions may exist in the next few hours.

Risk profiles associated with historical traffic flow data and historic incident data is updated and stored in the repository (step 264) and the method continues with step 206 of FIG. 4.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A method of determining a collision risk forecast and root cause of a collision risk for road segments of a road network comprising the steps of:

a computer receiving data representative of real time conditions, real time social events, and historic conditions associated with road segments from a plurality of devices;

the computer determining a probability of collision risk for each road segment including the root cause comprising the steps of the computer:

determining all road segments of the road network from the data representative of real time conditions and social events;

applying data representative of historical conditions to each road segment to down sample data to account for imbalances and determine a number of collisions in each road segment;

determining major factors of relevance for causing collisions for each road segment from data received representative of real time conditions, real time social events and historic conditions;

applying models to the major factors of relevance to determine conditional probabilities and dependencies causing collisions in each road segment;

spatially smoothing the conditional probability of each road segment to determine a collision risk index with continuous metrics to create a spatial low pass filter;

applying the spatial low pass filter to each road segment to remove discontinuities; and simulating continuous probability to determine a road network risk estimation with a collision risk forecast and root cause of the collision risk for each road segment;

the computer sending a notification to at least some of the plurality of devices regarding the collision risk and root causes of collision for at least one road segment.

2. The method of claim 1, wherein the plurality of devices receiving the notification are located in the at least one road segment with the collision risk.

3. The method of claim 1, wherein the step of determining major factors of relevance for causing collisions in each road segment from data received representative of real time conditions, real time social events and historic conditions is determined by exploratory factor analysis.

4. The method of claim 1, wherein the model applied to the major factors of relevance to determine conditional probabilities and dependencies causing collisions in each road segment is Bayesian Network Inference.

5. The method of claim 1, wherein the plurality of devices are selected from a group consisting of: traffic signals, traffic cameras, security cameras, vehicle sensors personal devices of users in the at least one road segment, devices associated with emergency services, devices associated with traffic officials and devices associated with law enforcement.

6. The method of claim 1, wherein the collision risk forecast is for a future time period from when the real time data was captured by the plurality of devices.

7. The method of claim 1, wherein the collision risk forecast is specific to a type of driver behavior.

8. The method of claim 1, wherein the collision risk forecast is specific to a type of vehicle.

9. The method of claim 1, wherein the collision risk forecast is specific to a road type present in the each road segment.

10. A computer program product for determining a collision risk forecast and root cause of a collision risk for road segments of a road network using a decision making engine having a computer comprising at least one processor, one or more memories, one or more computer readable storage media, the computer program product comprising a computer readable storage medium having program instructions embodied therewith, the program instructions executable by the computer to perform a method comprising:

receiving, by the computer, data representative of real time conditions, real time social events, and historic conditions associated with each road segment from a plurality of devices;

determining, by the computer, a probability of collision risk for each road segment including the root cause comprising the program instructions of:

identifying all road segments of the road network from the data representative of real time conditions and social events;

applying data representative of historical conditions to each road segment to down sample data to account for imbalances and determine a number of collisions in each road segment;

determining major factors of relevance for causing collisions in each road segment from data received representative of real time conditions, real time social events and historic conditions;

applying models to the major factors of relevance to determine conditional probabilities and dependencies causing collisions in each road segment;

spatially smoothing the conditional probability of each road segment to determine a collision risk index with continuous metrics to create a spatial low pass filter;

applying the spatial low pass filter to each road segment to remove discontinuities; and simulating continuous probability to determine a road network risk estimation with a collision risk forecast and root cause of the collision risk for each road segment;

sending, by the computer, a notification to at least some of the plurality of devices regarding the collision risk and root causes of collision for the at least one road segment.

11. The computer program product of claim 10, wherein the plurality of devices receiving the notification are located in the at least one road segment with the collision risk.

12. The computer program product of claim 10, wherein the program instructions of determining, by the computer, major factors of relevance for causing collisions in each road segment from data received representative of real time conditions, real time social events and historic conditions is determined by exploratory factor analysis.

13. The computer program product of claim 10, wherein the model applied to the major factors of relevance to determine conditional probabilities and dependencies causing collisions in each road segment is Bayesian Network Inference.

14. The computer program product of claim 10, wherein the collision risk forecast is for a future time period from when the real time data was captured by the plurality of devices.

15. The computer program product of claim 10, wherein the collision risk forecast is specific to a type of driver behavior.

16. The computer program product of claim 10, wherein the collision risk forecast is specific to a type of vehicle.

17. The computer program product of claim 10, wherein the collision risk forecast is specific to a road type present in each road segment.

18. A computer system for determining a collision risk forecast and root cause of a collision risk for road segments of a road network comprising a decision making engine having a computer comprising at least one processor, one or more memories, one or more computer readable storage media having program instructions executable by the computer to perform the program instructions comprising:

receiving, by the computer, data representative of real time conditions, real time social events, and historic conditions associated with each road segment from a plurality of devices;

determining, by the computer, a probability of collision risk for each road segment including the root cause comprising the program instructions of:

identifying all road segments of the road network from the data representative of real time conditions and social events;

applying data representative of historical conditions to each road segment to down sample data to account for imbalances and determine a number of collisions in each road segment;

determining major factors of relevance for causing collisions in each road segment from data received representative of real time conditions, real time social events and historic conditions;

applying models to the major factors of relevance to determine conditional probabilities and dependencies causing collisions in each road segment;

spatially smoothing the conditional probability of each road segment to determine a collision risk index with continuous metrics to create a spatial low pass filter;

applying the spatial low pass filter to each road segment to remove discontinuities; and simulating continuous probability to determine a road network risk estimation with a collision risk forecast and root cause of the collision risk for each road segment;

sending, by the computer, a notification to at least some of the plurality of devices regarding the collision risk and root causes of collision for the at least one road segment.

19. The computer system of claim 18, wherein the program instructions of determining, by the computer, major factors of relevance for causing collisions in each road segment from data received representative of real time conditions, real time social events and historic conditions is determined by exploratory factor analysis.

20. The computer system of claim 18, wherein the model applied to the major factors of relevance to determine conditional probabilities and dependencies causing collisions in each road segment is Bayesian Network Inference.

* * * * *